US005437892A

United States Patent [19]

Nagayama et al.

[11] Patent Number: 5,437,892

[45] Date of Patent: Aug. 1, 1995

[54] METHOD FOR MANUFACTURING A FINE-PARTICLES TWO-DIMENSIONAL AGGREGATE FROM A LIQUID DISPERSION OF FINE PARTICLES

[75] Inventors: Kuniaki Nagayama, Tokyo; Nikolai D. Denkov, Sofia; Tzetzo D. Douchkin; Hideyuki Yoshimura, both of Tsukuba, all of Japan

[73] Assignee: Research Development Corporation of Japan, Tokyo, Japan

[21] Appl. No.: 113,664

[22] Filed: Aug. 31, 1993

[30] Foreign Application Priority Data

Aug. 31, 1992 [JP] Japan ..... 4-231838
Nov. 11, 1992 [JP] Japan ..... 4-300869

[51] Int. Cl.[6] ..... B05D 3/00; B05D 1/32

[52] U.S. Cl. ..... 427/372.2; 427/282; 427/389.7

[58] Field of Search ..... 427/372.2, 389.7, 350, 427/282

[56] References Cited

U.S. PATENT DOCUMENTS

| | | | |
|---|---|---|---|
| 4,032,901 | 6/1977 | Levinthal | 340/174 NC |
| 4,735,909 | 4/1988 | Albright et al. | 437/4 |
| 4,801,476 | 1/1989 | Dunsmuir et al. | 427/430.1 |
| 4,902,567 | 2/1990 | Eilertsen et al. | 428/328 |
| 4,929,406 | 5/1990 | Abe et al. | 264/45.5 |
| 4,974,373 | 12/1990 | Kawashima et al. | 51/295 |
| 5,284,729 | 2/1994 | Tanaka et al. | 430/66 |

OTHER PUBLICATIONS

Kralchevsky et al., Protein Array Project, ERATO, JRDC, "Capillary Forces Between Colloidal Particles", pp. 1-72, 1993.

Paunov et al., Journal of Colloid and Interface Science, "Lateral Capillary Forces between Floating Submillimeter Particles", vol. 157, pp. 100-112, 1993.

Yamaki et al., Nagayama Protein Array Project, ERATO, JRDC, "A Thin Liquid Layer on the Surface of Mercury as a Matrix of a Flow-Mediated Two-Dimensional Assembly of Proteins", 1993.

Denkov et al., American Chemical Society, "Mechanism of Formation of Two-Dimensional Crystals from Latex Particles on Substrates", vol. 8, No. 12, 1992.

Dushkin et al., Chemical Physics Letters, vol. 204, Nos. 5,6, "Nucleation and growth of two-dimensional colloidal crystals", pp. 455-460, Mar. 26, 1993.

Nagayama, "Surface", 31, pp. 353-360, 1993.

Yoshino, S., "Superlong range attractive and repulsive interactions between colloid particles," AIP Conf. Proc., 256 (slow Dyn. Condens. Matter), 354-5 (1992).

*Primary Examiner*—Terry J. Owens

*Attorney, Agent, or Firm*—Wenderoth, Lind & Ponack

[57] ABSTRACT

Method and apparatus for forming a two-dimensional assembly of fine particles on a surface. A wall cell is placed in contact with or near the surface of a solid substrate so as to form a closed surface region on the surface of the solid substrate, a liquid containing fine particles is injected onto the closed surface region in the wall cell, and then the liquid is removed at a controlled rate, thereby causing a two-dimensional assembly of fine particles to form on the solid surface.

9 Claims, 10 Drawing Sheets

METHOD FOR MANUFACTURING A FINE-PARTICLES TWO-DIMENSIONAL AGGREGATE FROM A LIQUID DISPERSION OF FINE PARTICLES

FIELD OF THE INVENTION

The present invention relates to a method for manufacturing a fine-particles two dimensional assembly and an apparatus therefor. More particularly, the present invention relates to a method for manufacturing a fine-particles two-dimensional aggregate used in the preparation of a new functional material in such areas as lithography, microelectronics, image processing, biomaterials, ceramics and metal materials.

PRIOR ART

Methods and apparatuses for two-dimensional deployment of fine particles (protein, oxides, metals, latex and polymers) and forming an assembly structure by controlling same have conventionally been studied. For example, there has been tried a method comprising precipitating fine particles from a liquid dispersion on a gas-liquid interface or a liquid-liquid interface and aggregating the resultant precipitate.

However, it is not so easy to form and control rapidly an assembly structure of fine particles at a high accuracy. Actually, methods and apparatuses tried so far had respective limits.

In the conventional precipitation method, for example, while it is relatively easy to make a two-dimensional film with a single layer of particles, a uniform film quality is unavailable. All these conventional methods of preparation basically comprise deploying a liquid containing particles onto a solid substrate and aggregating the fine particles by removing the solvent from this solution. For the purpose of obtaining a uniform two-dimensional assembly, various improvements have been made in these methods, including spin coating of the solution onto the substrate, drying and solidification, addition of a surfactant, deployment into the gap between two substrates, and shape control of the solvent meniscus.

In spite of these improvements, it has still been difficult to form a uniform fine-particle film and it has been impossible to accurately control the structural regularity of the fine-particle assembly.

Under such circumstances, the present inventor has already invented quite a new method for forming high-accuracy and rapid aggregation of fine-particles.

This method comprises highly controlling the aggregation of fine particles as induced by a meniscus force, for example, newly discovered by the present inventor.

More specifically, as illustrated in FIG. 1, for example, by supplying fine particles (A) and (B) dispersed in a liquid dispersion medium (I) onto a substrate (III) having a flat surface, and controlling the film thickness (d) of the liquid dispersion medium (I) to approximately the particle's diameter of the fine particles (A) and (B), preferably to below the diameter, by evaporation, for example, then, a large suction force (F) acts on the fine particles (A) and (B), thus forming a nuclear assembly of fine particles.

The meniscus force produced as such a suction force (F) is theoretically estimated to depend upon the wet angle ($\theta$) between the fine particles and the liquid dispersion medium (I), the thickness (d) of the liquid dispersion medium (I) at a sufficient distance, the diameter (2r) of the fine particles (A) and (B), the interfacial tension between the liquid dispersion medium (I) and a medium (II) (surface tension when the medium (II) is air), and the difference in density between the liquid dispersion medium (I) and the medium (II). The meniscus force is a very long-distant force and is considered to be proportional to the inverse number of the distance (1) between the fine particles. Because of such a long distance, the gravitational force acts between particles at a fairly long distance.

A two-dimensional assembly of fine particles is formed on the flat-surface substrate (III) by the above-mentioned meniscus force, etc.

When forming a two-dimensional assembly of fine particles by the new method, in order to improve the reproducibility thereof and obtain a two-dimensional assembly of fine particles at a high accuracy, it is necessary to effectively control the evaporation rate and the meniscus force. However, a satisfactory means to control these factors has not as yet been technically established. Consequently, the two-dimensional assembly has not been uniform, and has been restricted for the improvement of its forming efficiency.

SUMMARY OF THE INVENTION

The present invention was developed in view of the circumstances as described above, and has an object to provide a method and an apparatus for manufacturing a two-dimensional assembly of fine particles, which permits high-accuracy and efficient control of the film thickness of the liquid dispersion medium and the meniscus force.

To achieve the above-mentioned object, the present invention provides a method for manufacturing a two-dimensional assembly of fine particles, which comprises the steps of arranging a wall cell forming a closed surface region on the surface of a solid substrate, injecting a liquid containing fine particles onto the closed surface region in the wall cell, and then removing the liquid to form two-dimensional assembly of the fine particles onto the solid surface.

In addition, as one of the apparatuses for this purpose, the present invention provide an apparatus for forming a two-dimensional assembly of fine particles, which is an apparatus provided with a wall cell forming a closed surface region on the surface of a solid substrate, in which the wall cell is arranged in contact with, or near, the solid substrate surface, and which has a means to remove a liquid from the liquid containing fine particles, injected into the closed region formed by the substrate surface and the wall cell, thereby generating two-dimensional aggregation of the fine particles along with removal of liquid from the liquid containing fine particles.

DETAILED DESCRIPTION OF THE INVENTION

Figure 1:
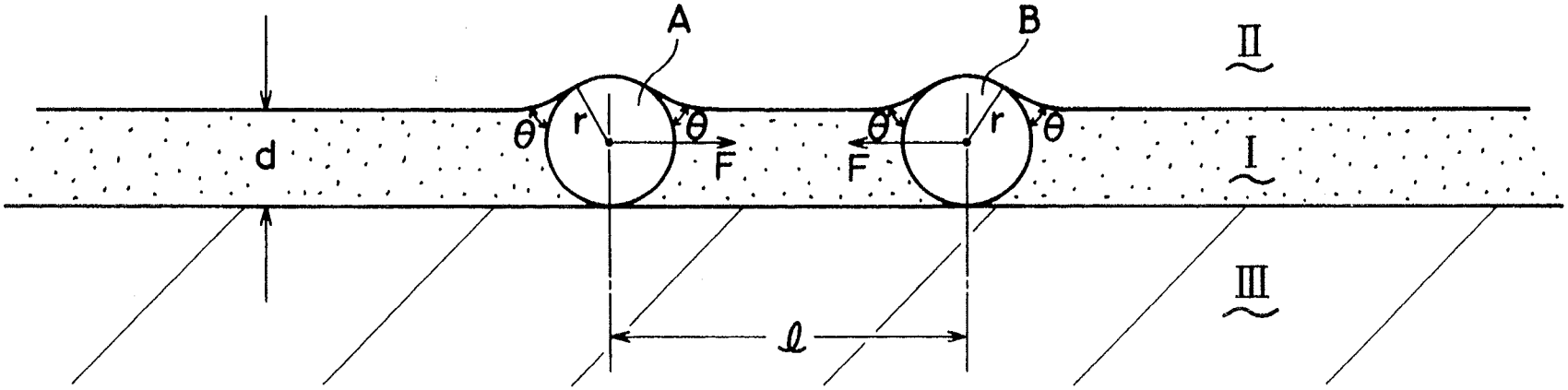
FIG. 1 is a schematic representation illustrating the meniscus force forming the theoretical basis for the present invention.
Figure 2:
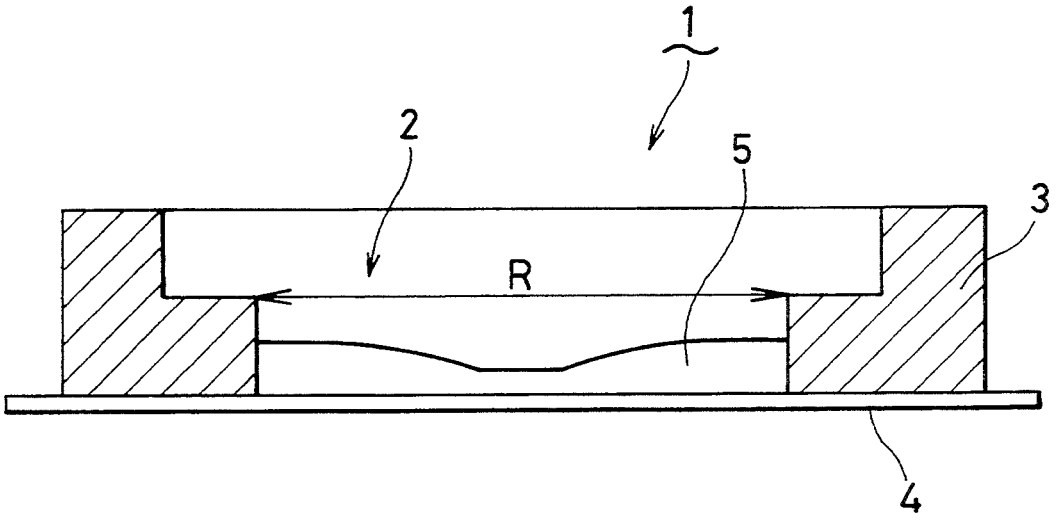
FIG. 2 is a sectional view illustrating an embodiment of the circular cell applicable for the method for manufacturing a two-dimensional assembly.

In the manufacturing method of two-dimensional assembly of the present invention, a circular wall cell as shown in FIG. 2 is used. This circular cell (1) has a structure in which the bottom of a partition (3) having a hole (2) of a diameter of several mm formed therein is tightly closed with a solid substrate (4). The diameter (R) of the inner hole (2) of the partition (3) may be for example of the order of 2 to 4 mm to permit manufacture of an assembly film of fine particles of a size of up to 200 nm (may be called nanometer fine particles), or may be larger to permit accurate manufacture of a large-area two-dimensional assembly. There is no particular restriction on the material of the partition (3), which may for example be solid paraffin fluorine resin, etc. There is no particular restriction on the kind of the solid substrate (4): any appropriate one such as glass or mica may be used. The surface thereof may be coated, for example, with a thin film of carbon or metal such as gold. In this case, it is possible to previously apply a hydrophilic treatment by any surface treatment method such as sputtering to the surface.

By employing such a circular wall cell (1), it is possible to prepare the two-dimensional assembly of nanometer particles, for example, with a high reproducibility and with formation of the two-dimensional assembly of fine particles always starting from the center of the hole (2).

A liquid containing dispersed fine particles to be formed, or a liquid comprising a solution in which fine particles can precipitate from the solution during operation is injected into the inner hole (2) of the circular wall cell (1). This liquid (5) may be, apart from water, alcohol, acetone, xylene or any other volatile liquid.

Figure 3:
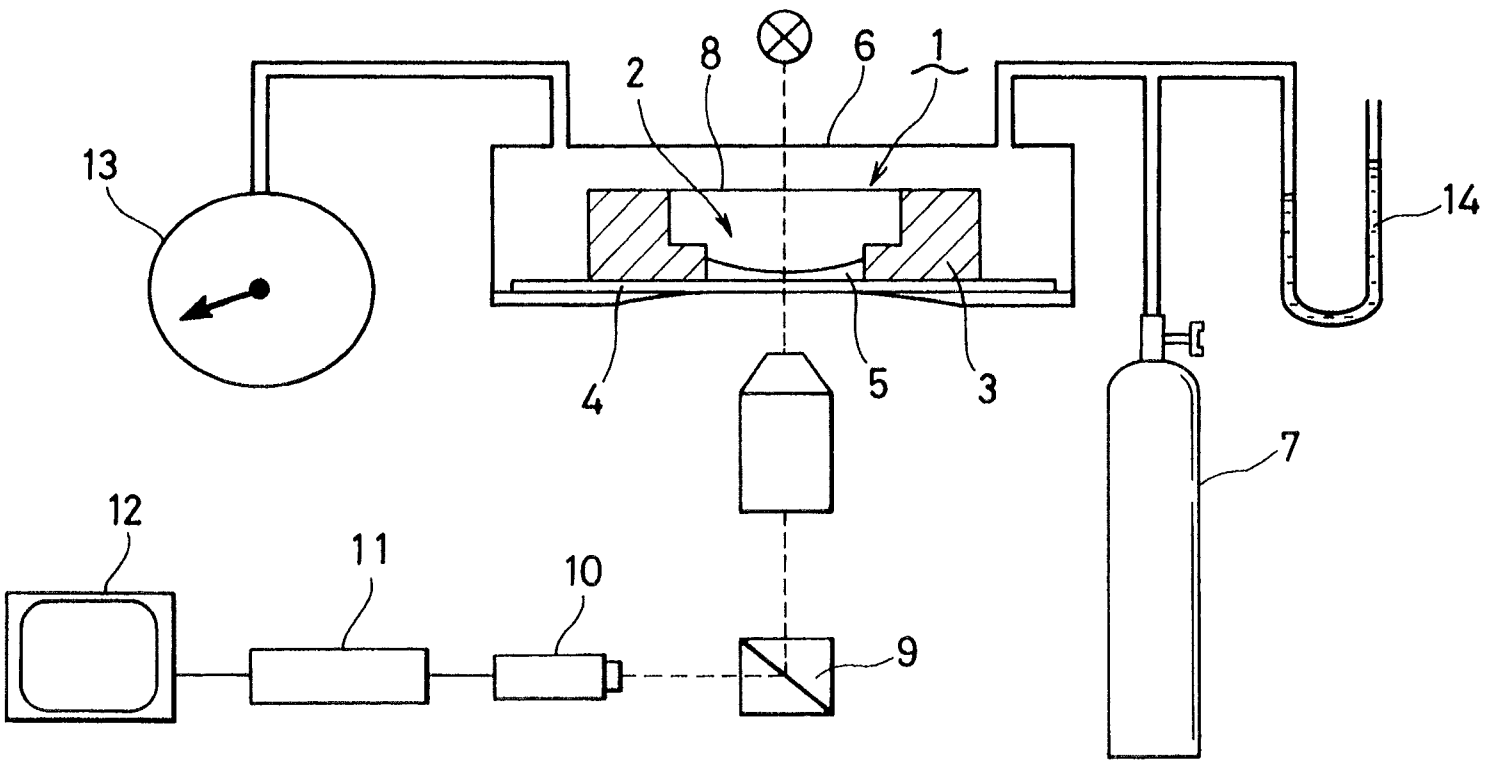
FIG. 3 is a block diagram illustrating the structure of an apparatus applicable for the method of the present invention.

Then, the water or other solvent constituent is evaporated from this liquid (5). Upon evaporation of the solvent constituent, the evaporation rate of the solvent may be controlled by arranging a cover (8) such as a glass plate on the top of the circular wall cell (1), as shown in FIG. 3, and adjusting the position of this cover (8), thereby changing the evaporation area. Or, the evaporation rate may be controlled through temperature control within the container (6).

As the solvent evaporates, fine particles are aggregated as crystal-like uniform assembly structure onto the solid substrate (4) by the aggregation force produced along with this evaporation.

The progress of this two-dimentional aggregation may be recorded by a video cassette recorder (11) via a microscope (9) and a CCD (Charged Coupled Device) camera (10), and observed on a monitor (12).

In the present invention, furthermore, preferable embodiments include arrangement of a temperature controlling means in the tightly closed container, provision of a slope at the end of the inner wall of the circular wall cell opposing to the substrate, and provision of a gap at the end of the circular wall cell opposing to the substrate, thereby controlling the liquid film pressure within the cell by this gap communicating with the cell interior.

Figure 4A:
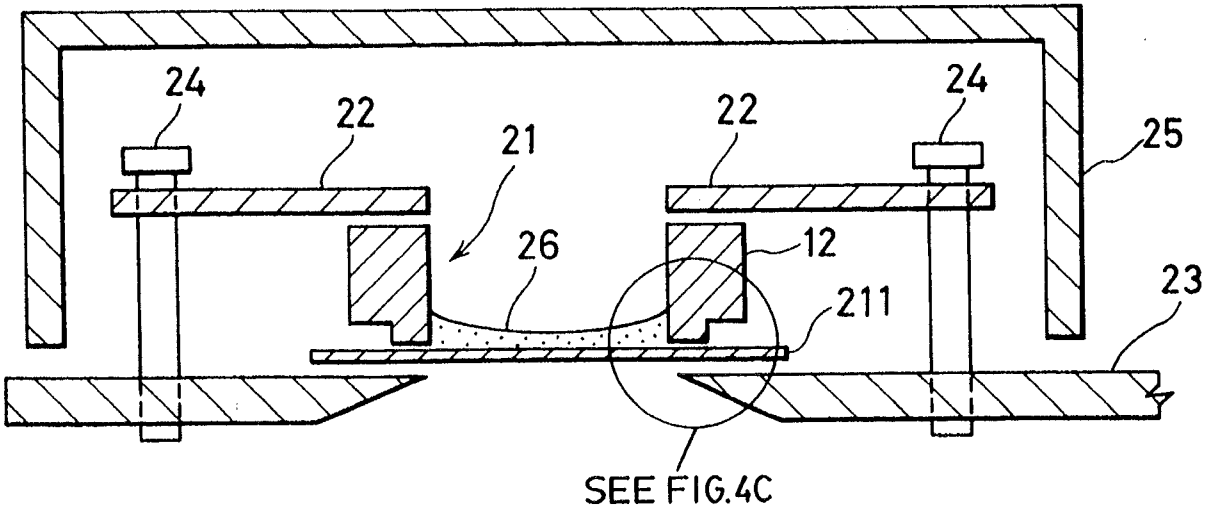
FIG. 4 is a sectional view illustrating another embodiment of the apparatus of the present invention.
Figure 4C:
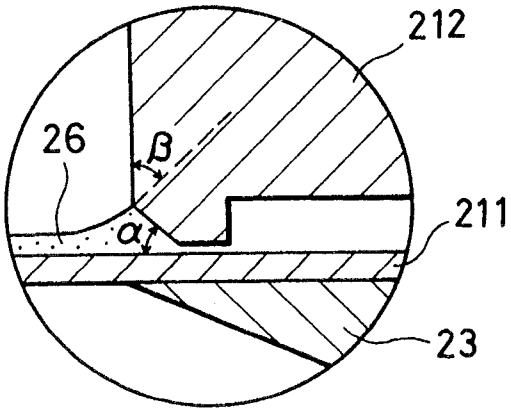
Figure 4B:
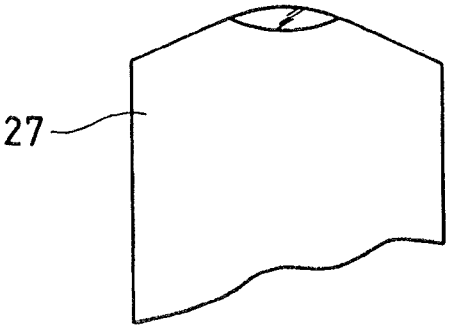

An apparatus for forming a two-dimensional assembly for this purpose is, for example, the one shown in FIG. 4.

This apparatus has a structure of a tightly closed container, in which a cell structure (21) having a circular wall cell (212) being in contact with, or near, a flat-surface substrate (211) is secured with rivets (24) to a cell fixing stand (23) such as that of a microscope through a fixing plate (22), and the entire structure is covered with a hood (26). This hood (25) not only prevents outside impurities from coming into the cell, but also controls evaporation of the liquid dispersion medium (26) in the ring.

Meniscus force is produced by charging fine particles and a liquid dispersion medium (26) into this annular wall cell (212) having a circular or polygonal shape, and subsequently, controlling the film thickness of the liquid dispersion medium (26), thereby forming a two-dimensional assembly. During this operation, the process may be observed through, for example, an optical microscope (27).

In the present invention, furthermore, it is effective to provide a slope at the end of the inner wall of the annular wall cell (212) opposing to the flat-surface substrate (211), as shown in the enlarged view of FIG. 4, and making an acute angle ($\alpha$) between the inner wall of the ring in contact with the liquid dispersion medium and the flat-surface substrate. By doing this, it is possible to keep a small contact angle ($\beta$) between the liquid dispersion medium and the cell wall, and thus to further stabilize the meniscus force. It is consequently possible to form a more accurate two-dimensional assembly.

Figure 5A:
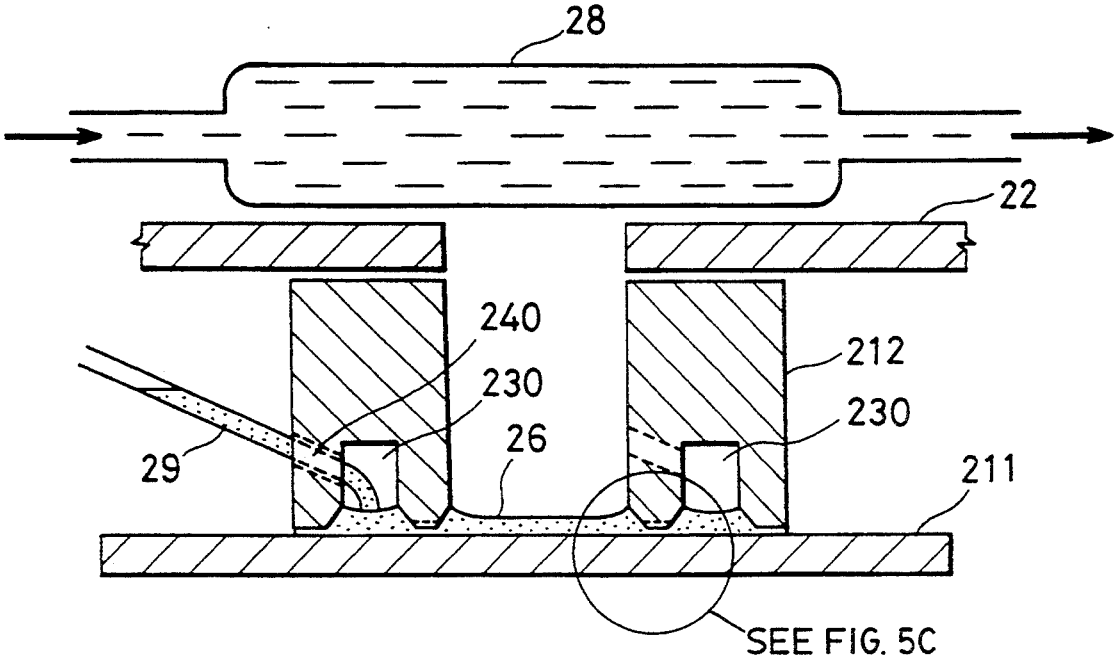
FIG. 5 is a sectional view illustrating further another embodiment of the apparatus of the present invention.
Figure 5B:
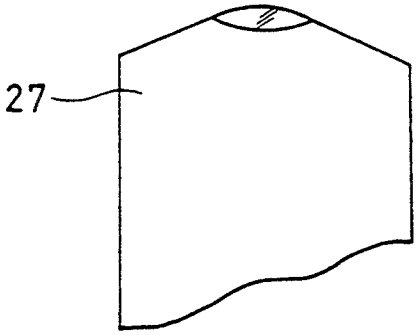
Figure 5C:
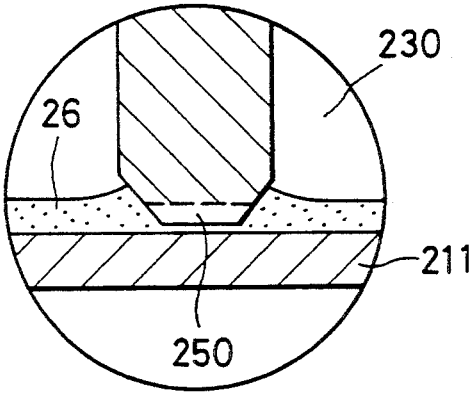

In the present invention, moreover, as shown in FIG. 5, it is also effective to provide a temperature controller (28) near the cell structure (21) with a view to improving the control accuracy of film thickness of the liquid dispersion medium. As the temperature controller (28), any appropriate one such as a heater using a heating wire, or a small-diameter tube for circulation of hotwater, for example, may be used.

In the present invention, the film thickness of the liquid dispersion medium (26) may be controlled through a capillary tube (29) to be indidentally provided. In this case, a channel (240) communicating between the gap (230) and the cell outside is provided on a portion of the annular wall cell (212) having the gap (230) at the end facing the substrate (211) as shown in FIG. 5, for example. Then, a slit (250) communicating between the gap and the cell interior is provided, and the capillary tube (29) is inserted through the channel (240) into the gap (230) and fixed there. The liquid dispersion medium present in the gap (230) is sucked or pressed by means of this capillary tube, thereby controlling the gap (239) and the film thickness of the liquid dispersion medium (26) through the slit (250).

This control of the film thickness of the liquid dispersion medium makes it possible to manufacture a thin film with a two-dimensional assembly of fine particles at a higher accuracy.

It is possible to convert the two-dimensional assembly formed in accordance with the present invention to a functionally more excellent assembly (crystal-like uniform structure) by applying a chemical modification, or processing or modification by, for example, laser or other beam to the two-dimensional assembly thus formed. By laminating this assembly, a lamination comprising a plurality of layers of this assembly may be achieved. It is thus possible to apply the method of the present invention for the creation of new functional materials in such areas as electronics, biomaterials, ceramics, metals and polymers, and to apply same to new physical and chemical processes and measuring instruments.

The method for manufacturing the two-dimensional assembly of fine particles of the present invention will be described further in detail by means of some examples.

EXAMPLE 1

A circular wall cell (1) as shown in FIG. 2, was prepared by piercing a hole having a diameter of 2 to 4 mm in a commercially available solid paraffin block and tightly closing it at the bottom with a glass substrate. This inner hole (2) of the circular cell (1) was filled with a 144 nm-diameter polystyrene sphere dispersion aqueous solution. The aqueous solution containing dispersed polystyrene spheres had a concentration of 0.1 wt. % and a volume of 1 to 4 μl.

Then, the top of the circular wall cell (1) was covered with a glass plate. The thus covered circular wall cell was housed in a container (6) of the apparatus shown in FIG. 3, and water was evaporated while adjusting the position of the glass plate. The atmosphere used in this example was the air.

Figure 6:
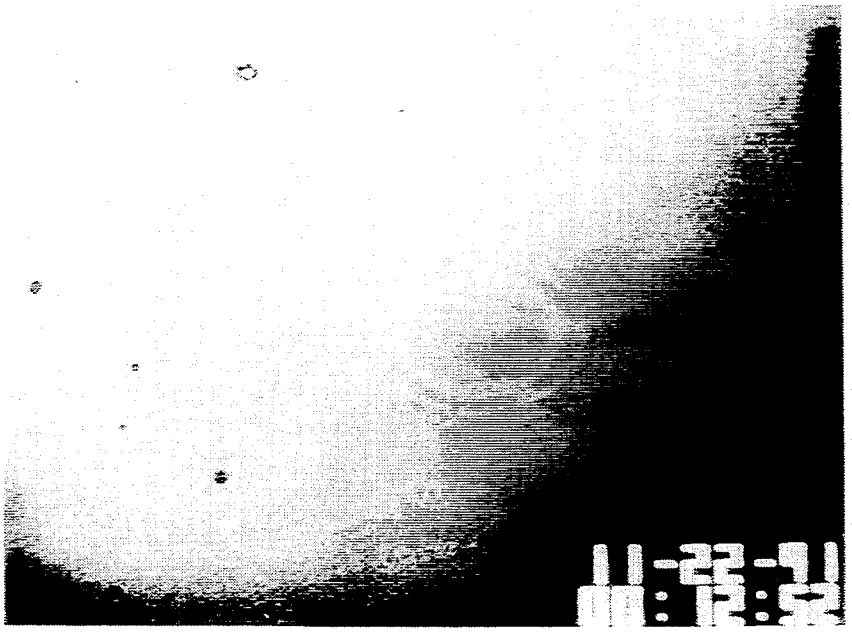
FIG. 6 is a view illustrating the nuclear formation process of two-dimensional assembly of nanometer particles.
Figure 7:
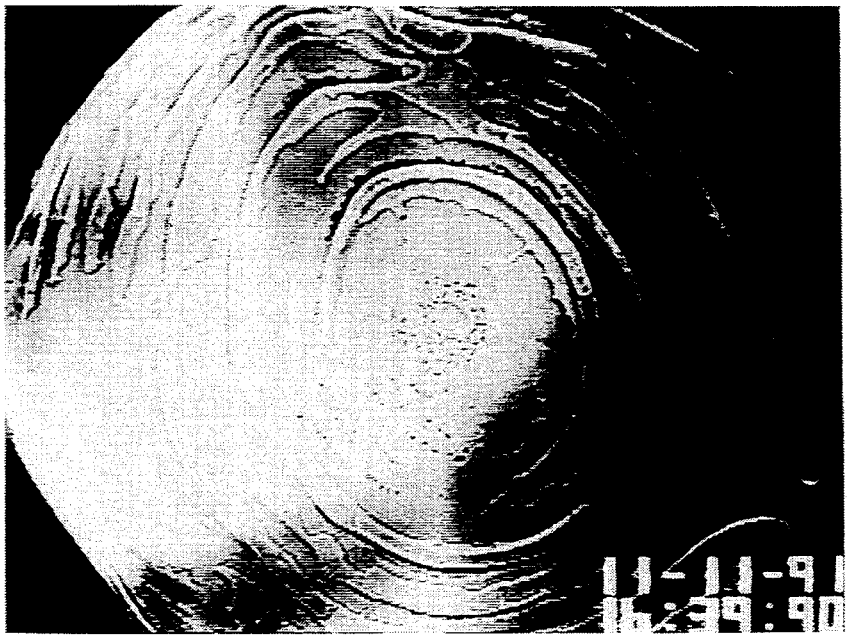
FIG. 7 is a view illustrating the process of growth of two-dimensional assembly of nanometer particles.

At the moment when the surface level of the polystyrene spere solution became of the same order as the particle diameter of the polystyrene spheres, or the particles slightly appeared on the water surface, aggregation of polystyrene spheres was started at the center. When it was held while keeping a constant evaporation rate, particles gathered around nuclei from surrounding portions, resulting in aggregation (crystalline form) and growth. FIG. 6 illustrates the process of nuclear formation, and FIG. 7, the process of the growth of an assembly.

Figure 8:
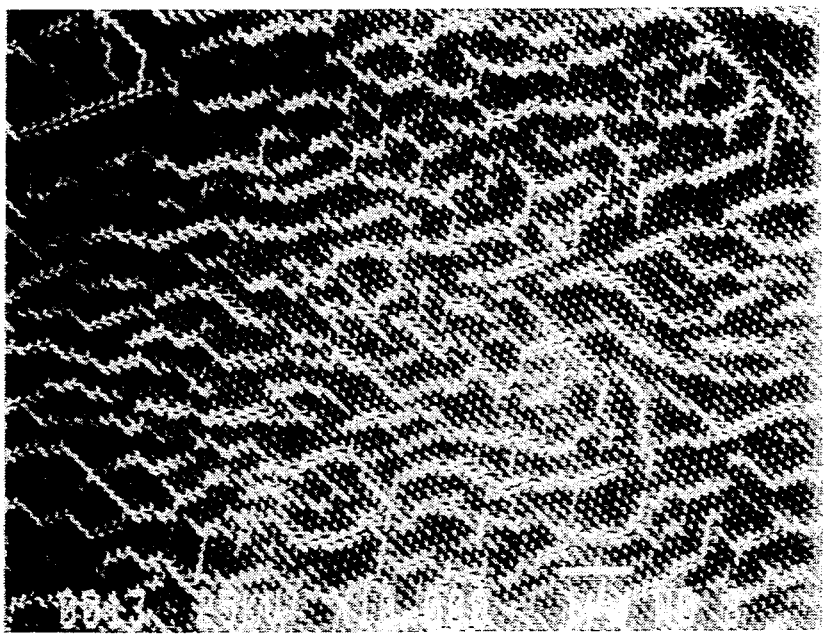
FIG. 8 is a scanning micrograph illustrating the two-dimensional crystal-like assembly of a polystyrene sphere on a glass substrate.

As shown in FIG. 8, observation with a scanning-type microscope permitted confirmation of the formation of a two-dimensional crystal-like uniform structure as single layer of polystyrene spheres on the glass substrate.

EXAMPLE 2

In the same manner as in the Example 1, a circular cell using a mica substrate was filled with a 144 nm-diameter polystyrene sphere aqueous solution, and water was evaporated in air.

Figure 9:
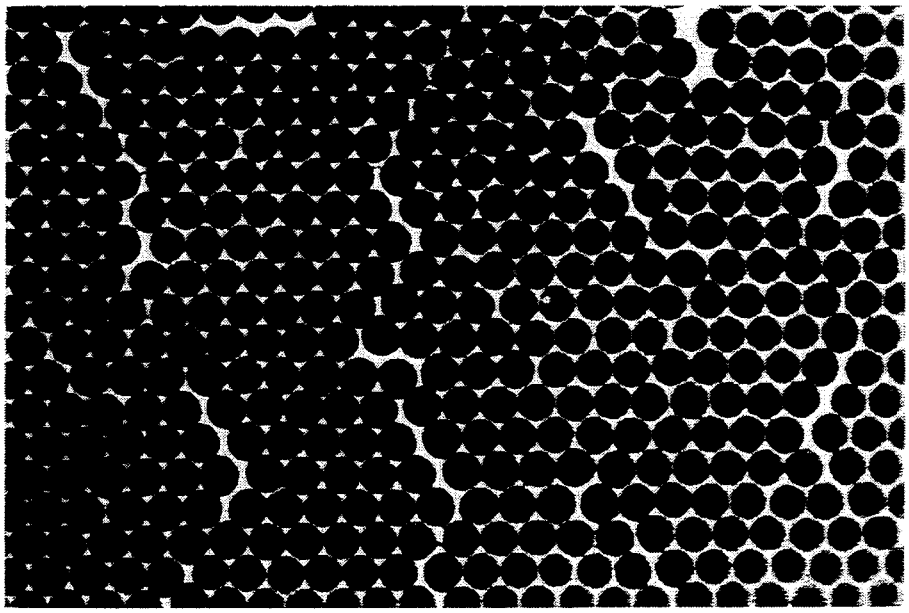
FIG. 9 is a transmission-type electron micrograph illustrating the crystal-like two-dimensional assembly of a polystyrene sphere on a mica substrate.
Figure 10:
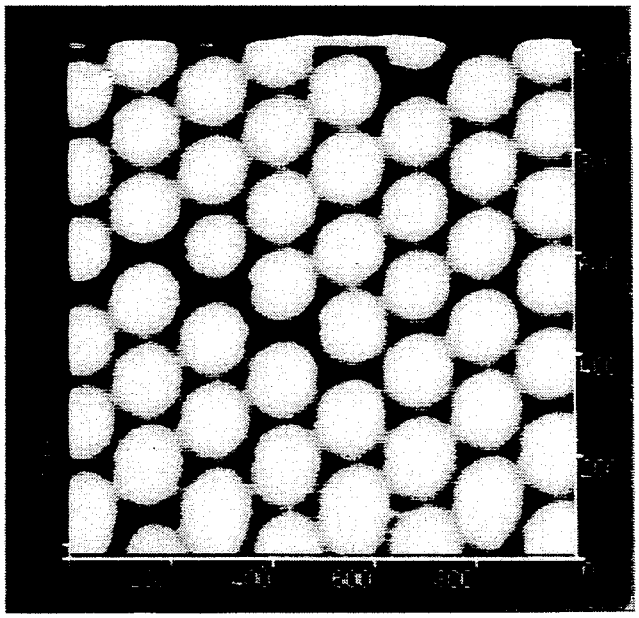
FIG. 10 is an inter-atomic micrograph corresponding to FIG. 9.

By means of a transmission-type electron microscope shown in FIG. 9 and an inter-atomic microscope shown in FIG. 10, formation of a two-dimensional assembly (crystal-like structure) of polystyrene spheres on the mica substrate was observed.

EXAMPLE 3

In the same manner as in the Examples 1 and 2, a two-dimensional assembly (crystal-like structure) of 55 nm-diameter polystyrene spheres was formed on a mica substrate. This example was carried out in two kinds of atmosphere, including the air and oxygen.

Figure 11:
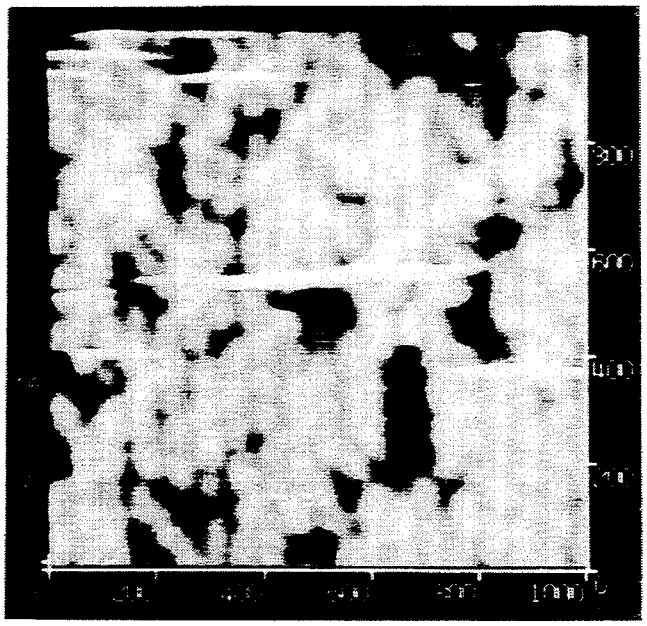
FIG. 11 is another inter-atomic micrograph illustrating the crystal-like two-dimensional assembly of a polystyrene sphere on a mica substrate.

As a result, the formation of a two-dimensional assembly of polystyrene spheres was observed in the oxygen atmosphere with an inter-atomic microscope, as is clear from FIG. 11. No two-dimensional crystal-like assembly was formed in the air atmosphere.

EXAMPLE 4

A two-dimensional crystal-like assembly having a uniform structure of 55 nm-diameter polystyrene spheres was prepared in the same manner as in the Example 3, except that a carbon-coated glass substrate was used as the solid substrate.

Figure 12:
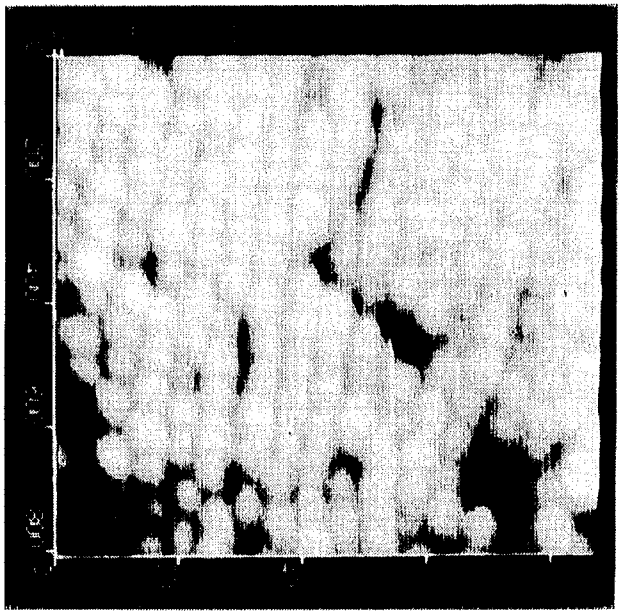
FIG. 12 is an inter-atomic micrograph illustrating the two-dimensional crystal-like assembly of polystyrene spheres on a carbon-coated glass substrate.

Observation with an inter-atomic microscope permitted confirmation, as shown in FIG. 12, of formation of a two-dimensional crystal-like assembly structure in an oxygen atmosphere. No two-dimensional crystal-like assembly structure was formed in the air atmosphere.

It is needless to mention that the present invention is not limited in any manner by the above-mentioned examples. Various other embodiments are of course possible in respect to the details of the nanometer particles, kinds of solvents and solid substrate, atmospheres and equipment configurations.

It is now possible, by the application of the present invention, to cause nanometer particles having a particle size of up to 200 nm to a form crystal-like two dimensional structure at a high reproducibility. Wide-range applications are expected in such areas as optics, lithography, microelectronics and image processing.

EXAMPLE 5

Using a two-dimensional assembly forming apparatus provided, as shown in FIG. 5, with a temperature controller controlling the evaporation rate of a liquid dispersion medium, by bringing an end of the Teflon® wall of a 1.4 cm-diameter circular cell structure into contact with a glass flat-surface substrate, through the temperature of circulated hot water, and a capillary tube for controlling the pressure of the liquid dispersion medium, the cell interior was filled with a dispersion water of 1.70 μm-diameter polystyrene spheres (concentration: 1 wt. %, temperature: 25° C.), thereby forming a two-dimensional assembly.

Figure 13A:
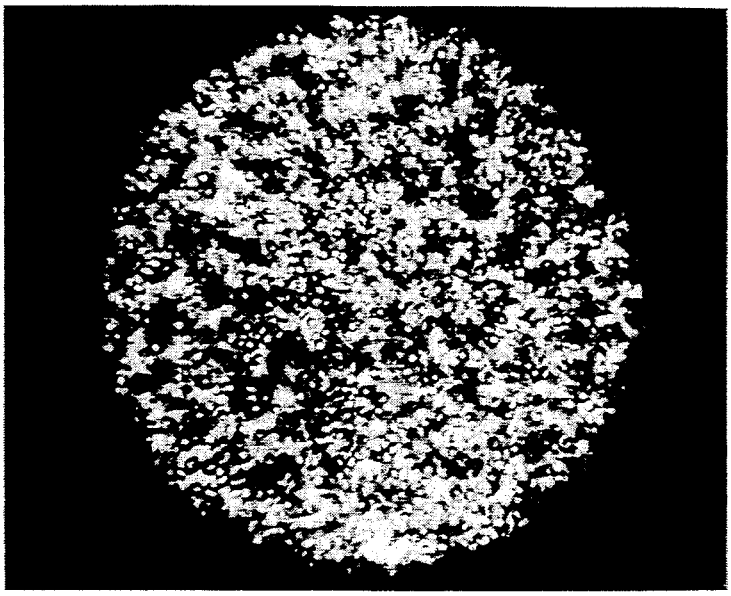
FIGS. 13(*a*), 13(*b*) and 13(*c*) are optical micrographs illustrating examples of the present invention.
Figure 13B:
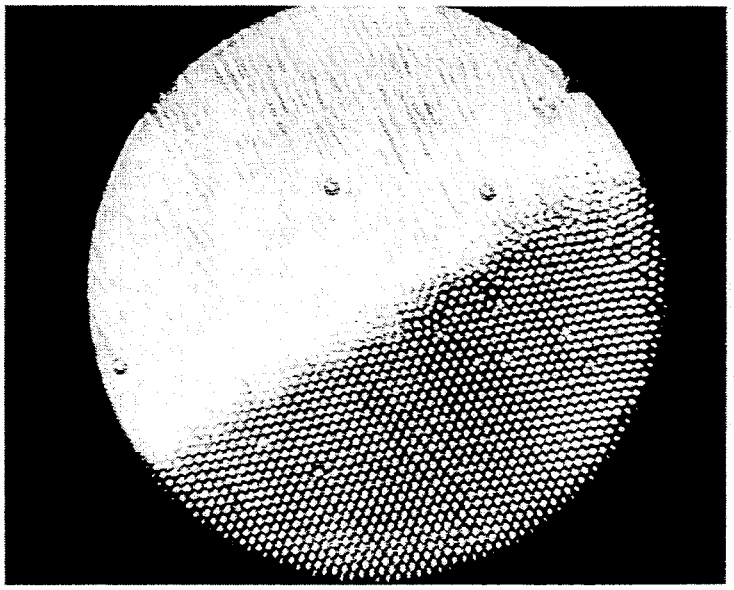
Figure 13C:
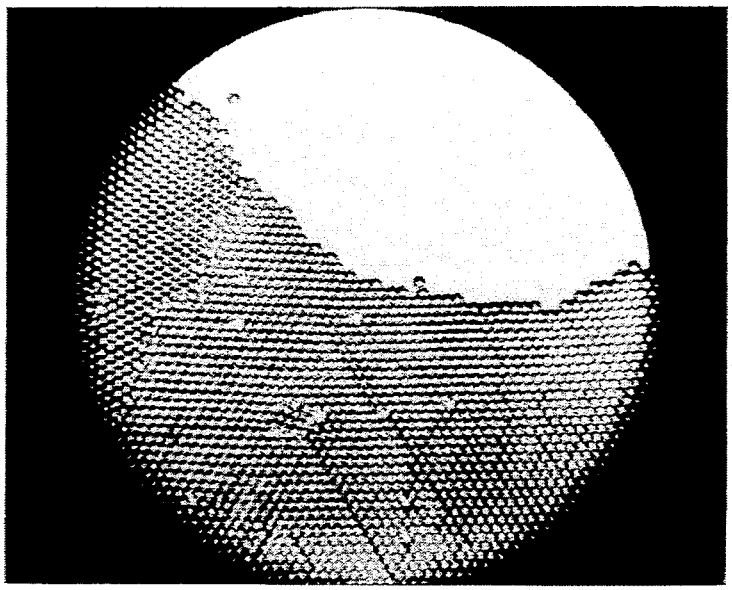

In this operation, the surface level of the dispersion water of polystyrene spheres in the cell was reduced by evaporation. FIG. 13 illustrates the results of observation of the forming process of the two-dimensional assembly. FIG. 13(*a*) shows the state in which concentration of the fine particles is started by the evaporation of the liquid dispersion medium; FIG. 13(*b*) shows the state in which continued evaporation produces a water flow in a direction and fine particles assembly on this flow, thus growing the two-dimensional assembly; and FIG. 13 (C) shows the state in which growth of the two-dimensional assembly is completed and the fine particles now form a single-layer two-dimensional aggregate.

As shown in these drawings, the formed two-dimensional particles was uniform. It was thus possible to form two-dimensional assembly (crystal-like uniform structure of assembly) of fine particles efficiently at a high accuracy on the solid surface.

What is claimed is:

1. A method for manufacturing a fine-particle two-dimensional assembly, which comprises the steps of arranging a wall cell forming a closed surface region on the surface of a solid substrate, injecting a liquid containing fine particles into the closed surface region in said wall cell, and then removing the liquid, thereby forming two-dimensional assembly of the fine particles on the surface of the solid substrate.

2. A manufacturing method as claimed in claim 1, wherein said liquid is removed by evaporation.

3. A manufacturing method as claimed in claim 2, wherein the method is carried out in air or oxygen atmosphere.

4. A manufacturing method as claimed in claim 1, wherein said solid substrate has a surface coated with a carbon film or a metal film.

5. A manufacturing method as claimed in claim 1, wherein said two-dimensional assembly of fine particles is a two-dimensional assembly of fine particles having a size up to about 200 nm.

6. A manufacturing method according to claim 1 wherein the step of removing the liquid comprises reducing the thickness of the liquid to approximately the diameters of the fine particles therein to form the two-dimensional assembly of fine particles on the surface of the solid substrate.

7. A manufacturing method according to claim 1 wherein the step of removing the liquid comprises reducing the thickness of the liquid to below the diameters of the fine particles therein to form a two-dimensional assembly of fine particles on the surface of the solid substrate.

8. A manufacturing method according to claim 6 wherein the liquid is removed by evaporation.

9. A manufacturing method according to claim 7 wherein the liquid is removed by evaporation.

* * * * *